US011424554B2

(12) United States Patent
Ahn et al.

(10) Patent No.: US 11,424,554 B2
(45) Date of Patent: Aug. 23, 2022

(54) ANTENNA DEVICE

(71) Applicant: Samsung Electronics Co., Ltd., Suwon-si (KR)

(72) Inventors: Jungho Ahn, Seoul (KR); Seonghun Jeong, Suwon-si (KR); Moonseok Choi, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 228 days.

(21) Appl. No.: 16/482,178

(22) PCT Filed: Feb. 14, 2018

(86) PCT No.: PCT/KR2018/001949
§ 371 (c)(1),
(2) Date: Jul. 30, 2019

(87) PCT Pub. No.: WO2018/151537
PCT Pub. Date: Aug. 23, 2018

(65) Prior Publication Data

US 2019/0386402 A1 Dec. 19, 2019

(30) Foreign Application Priority Data

Feb. 14, 2017 (KR) ..... 10-2017-0019905

(51) Int. Cl.
*H01Q 1/48* (2006.01)
*H01Q 9/30* (2006.01)
*H01Q 21/30* (2006.01)

(52) U.S. Cl.
CPC ..... *H01Q 21/30* (2013.01); *H01Q 1/48* (2013.01); *H01Q 9/30* (2013.01)

(58) Field of Classification Search
CPC ..... H01Q 21/30; H01Q 1/48; H01Q 9/30; H01Q 5/30; H01Q 5/48; H01Q 5/50
See application file for complete search history.

(56) References Cited

U.S. PATENT DOCUMENTS

| | | | |
|---|---|---|---|
| 8,618,990 | B2 | 12/2013 | Somero |
| 2008/0231526 | A1 | 9/2008 | Sato |
| 2008/0252462 | A1 | 10/2008 | Sakama |
| 2012/0119955 | A1 | 5/2012 | Milosavljevic et al. |

(Continued)

FOREIGN PATENT DOCUMENTS

| | | | |
|---|---|---|---|
| JP | 2006005903 | A | 1/2006 |
| KR | 10-2008-0092244 | A | 10/2008 |

(Continued)

OTHER PUBLICATIONS

ISA/KR, "International Search Report and Written Opinion of the International Searching Authority," International Application No. PCT/KR2018/001949, dated May 30, 2018, 12 pages.

*Primary Examiner* — Jimmy T Vu

(57) ABSTRACT

An antenna device according to various embodiments comprises: a first antenna for transmitting and receiving a first frequency band signal, the first antenna having a first frequency as a resonance frequency; and a second antenna, disposed adjacent to the first antenna, for transmitting and receiving the first frequency band signal, the second antenna having a multiplication frequency of the first frequency as a resonance frequency. Other embodiments are possible.

9 Claims, 14 Drawing Sheets

(56) References Cited

U.S. PATENT DOCUMENTS

| | | | | |
|---|---|---|---|---|
| 2016/0087328 | A1* | 3/2016 | Lee | H01Q 1/44<br>343/702 |
| 2016/0191085 | A1 | 6/2016 | Kasnavi et al. | |
| 2018/0287268 | A1* | 10/2018 | Kosaka | H01Q 21/061 |

FOREIGN PATENT DOCUMENTS

| | | | | |
|---|---|---|---|---|
| KR | 10-2010-0004650 | A | | 1/2010 |
| KR | 10-2010-0060887 | A | | 6/2010 |
| KR | 10-2010-0128310 | A | | 12/2010 |
| KR | 10-2012-0012635 | A | | 2/2012 |
| KR | 10-2013-0005717 | A | | 1/2013 |
| KR | 20130005717 | A | * | 1/2013 |
| KR | 10-2014-0066008 | A | | 5/2014 |
| KR | 10-2015-0009395 | A | | 1/2015 |
| KR | 10-2016-0020378 | A | | 2/2016 |

* cited by examiner

ANTENNA DEVICE

CROSS-REFERENCE TO RELATED APPLICATIONS

This application is a 371 National Stage of International Application No. PCT/KR2018/001949, filed Feb. 14, 2018, which claims priority to Korean Patent Application No. 10-2017-0019905, filed Feb. 14, 2017, the disclosures of which are herein incorporated by reference in their entirety.

BACKGROUND

1. Field

Various embodiments of the disclosure relate to an antenna device and, more particularly, to an antenna device including an antenna, the resonance frequency of which is a multiple of a specific frequency to be transmitted/received.

2. Description of Related Art

Wireless communication technologies have recently been implemented in various types including not only commercialized mobile communication network access, but also wireless local area network (W-LAN) represented by Wi-Fi technology, Bluetooth, near-field communication (NFC), and low-power wide area network (LPWAN). Particularly, there has recently been an evolution from human-centered connection networks to Internet-of-Things (IoT) networks for exchanging and processing information between distributed constituent elements (for example, things). Through merging and combining various industries with existing information technology (IT), the IoT is applicable to various fields such as smart homes, smart buildings, smart cities, smart cars or connected cars, smart grids, heath care, smart home appliances, and cutting-edge medical services.

SUMMARY

An antenna device used for wireless communication is configured to transmit or receive a wireless communication signal in a specific frequency band. The antenna device is preferably capable of radiating signals evenly in all directions such that the transmitting/receiving function is not degraded by radio signal loss resulting from obstacles or the like. However, there is a problem in that, if multiple antennas having the same shape are arranged to selectively transmit/receive signals, the communication efficiency may improve, but the cost will increase due to the increased number of antennas and related design requirements.

An antenna device according to various embodiments of the disclosure has been made to solve the above-mentioned problems, and is capable of improving radiation performance efficiently by using an antenna, the resonance frequency of which is a multiple of a specific frequency to be transmitted/received.

An antenna device according to various embodiments of the disclosure may include: a first antenna having a first frequency as a resonance frequency thereof, the first antenna being configured to transmit/receive the first frequency band signal; and a second antenna having a multiple of the first frequency as a resonance frequency thereof, the second antenna being arranged adjacent to the first antenna so as to transmit/receive the first frequency band signal.

According to various embodiments of the disclosure, there may be provided an antenna device including an antenna, the resonance frequency of which is a multiple of a specific frequency to be transmitted/received, thereby securing an improved radiation performance compared with conventional antenna devices.

According to various embodiments of the disclosure, there may be provided an antenna device structure capable of securing a directionality having a 360° coverage at a low cost without having an additional antenna.

According to various embodiments of the disclosure, there may be provided an antenna device wherein degradation of antenna performance can be prevented even if a first antenna, the resonance frequency of which is a specific frequency to be transmitted/received, and a second antenna, the resonance frequency of which is a multiple of the specific frequency, are arranged closer than ½ wavelength.

DETAILED DESCRIPTION

Figure 1:
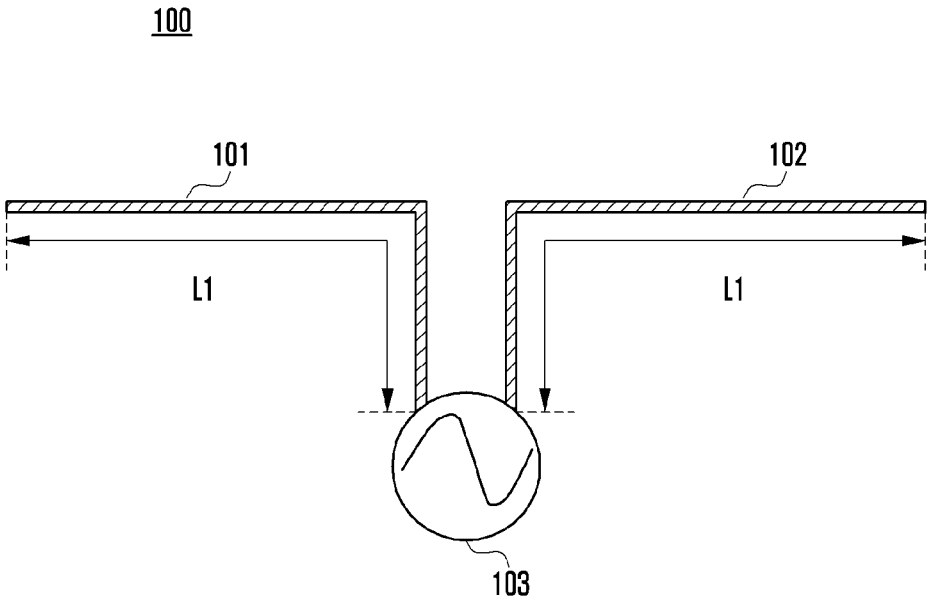
FIG. 1 is a diagram illustrating the configuration of an antenna device according to an embodiment.

Embodiments of the disclosure will be described herein below with reference to the accompanying drawings. However, the embodiments of the disclosure are not limited to the specific embodiments and should be construed as including all modifications, changes, equivalent devices and methods, and/or alternative embodiments of the present disclosure. In the description of the drawings, similar reference numerals are used for similar elements.

The terms "have," "may have," "include," and "may include" as used herein indicate the presence of corresponding features (for example, elements such as numerical values, functions, operations, or parts), and do not preclude the presence of additional features.

The terms "A or B," "at least one of A or/and B," or "one or more of A or/and B" as used herein include all possible combinations of items enumerated with them. For example, "A or B," "at least one of A and B," or "at least one of A or B" means (1) including at least one A, (2) including at least one B, or (3) including both at least one A and at least one B.

The terms such as "first" and "second" as used herein may use corresponding components regardless of importance or an order and are used to distinguish a component from another without limiting the components. These terms may be used for the purpose of distinguishing one element from another element. For example, a first user device and a second user device may indicate different user devices regardless of the order or importance. For example, a first element may be referred to as a second element without departing from the scope the disclosure, and similarly, a second element may be referred to as a first element.

It will be understood that, when an element (for example, a first element) is "(operatively or communicatively) coupled with/to" or "connected to" another element (for example, a second element), the element may be directly coupled with/to another element, and there may be an intervening element (for example, a third element) between the element and another element. To the contrary, it will be understood that, when an element (for example, a first element) is "directly coupled with/to" or "directly connected to" another element (for example, a second element), there is no intervening element (for example, a third element) between the element and another element.

The expression "configured to (or set to)" as used herein may be used interchangeably with "suitable for," "having the capacity to," "designed to," "adapted to," "made to," or "capable of" according to a context. The term "configured to (set to)" does not necessarily mean "specifically designed to" in a hardware level. Instead, the expression "apparatus configured to . . . " may mean that the apparatus is "capable of . . . " along with other devices or parts in a certain context. For example, "a processor configured to (set to) perform A, B, and C" may mean a dedicated processor (e.g., an embedded processor) for performing a corresponding operation, or a generic-purpose processor (e.g., a central processing unit (CPU) or an application processor (AP)) capable of performing a corresponding operation by executing one or more software programs stored in a memory device.

The terms used in describing the various embodiments of the disclosure are for the purpose of describing particular embodiments and are not intended to limit the disclosure. As used herein, the singular forms are intended to include the plural forms as well, unless the context clearly indicates otherwise. All of the terms used herein including technical or scientific terms have the same meanings as those generally understood by an ordinary skilled person in the related art unless they are defined otherwise. The terms defined in a generally used dictionary should be interpreted as having the same or similar meanings as the contextual meanings of the relevant technology and should not be interpreted as having ideal or exaggerated meanings unless they are clearly defined herein. According to circumstances, even the terms defined in this disclosure should not be interpreted as excluding embodiments of the disclosure.

An electronic device according to the disclosure may include at least one of, for example, a smart phone, a tablet personal computer (PC), a mobile phone, a video phone, an electronic book reader (e-book reader), a desktop PC, a laptop PC, a netbook computer, a workstation, a server, a personal digital assistant (PDA), a portable multimedia player (PMP), a MPEG-1 audio layer-3 (MP3) player, a mobile medical device, a camera, and a wearable device (e.g., a smart glasses, a head-mounted device (HMD), an electronic clothing, an electronic bracelet, an electronic necklace, an electronic appcessory, an electronic tattoo and a smart watch.

The electronic device may be a smart home appliance. The smart home appliance may include at least one of, for example, a television, a digital video disk (DVD) player, an audio, a refrigerator, an air conditioner, a vacuum cleaner, an oven, a microwave oven, a washing machine, an air cleaner, a set-top box, a home automation control panel, a security control panel, a TV box (e.g., Samsung HomeSync™, Apple TV™, or Google TV™), a game console (e.g., Xbox™ and PlayStation™), an electronic dictionary, an electronic key, a camcorder, and an electronic photo frame.

The electronic device may include at least one of various medical devices (e.g., various portable medical measuring devices (a blood glucose monitoring device, a heart rate monitoring device, a blood pressure measuring device, a body temperature measuring device, etc.), a magnetic resonance angiography (MRA), a magnetic resonance imaging (MRI), a computed tomography (CT) machine, and an ultrasonic machine), a navigation device, a global positioning system (GPS) receiver, an event data recorder (EDR), a flight data recorder (FDR), a vehicle infotainment device, an electronic device for a ship (e.g., a navigation device for a ship, and a gyro-compass), avionics, security devices, an automotive head unit, a robot for home or industry, an automatic teller machine (ATM) in banks, point of sales (POS) devices in a shop, or an Internet of things (IoT) device (e.g., a light bulb, various sensors, electric or gas meter, a sprinkler device, a fire alarm, a thermostat, a streetlamp, a toaster, a sporting goods, a hot water tank, a heater, a boiler, etc.).

The electronic device may include at least one of a part of furniture or a building/structure, an electronic board, an electronic signature receiving device, a projector, and various kinds of measuring instruments (e.g., a water meter, an electric meter, a gas meter, and a radio wave meter). The electronic device may be a combination of one or more of the aforementioned various devices. The electronic device may also be a flexible device. Further, the electronic device is not limited to the aforementioned devices, and may include an electronic device according to the development of new technology.

Hereinafter, an electronic device according to various embodiments will be described with reference to the accompanying drawings. In the disclosure, the term "user" may indicate a person using an electronic device or a device (e.g., an artificial intelligence electronic device) using an electronic device.

FIG. 1 is a diagram illustrating the configuration of an antenna device according to an embodiment.

An antenna device 100 according to various embodiments may include a first antenna 101 and a second antenna 102, which transmit/receive the same frequency band signal. Although various kinds of antennas may be considered as the first antenna 101 and the second antenna 102, it will be assumed in the following description of the disclosure that the first antenna 101 and the second antenna 102 are monopole antennas.

When supplied (fed) with an electric current from a feeding portion electrically connected to the antennas 101 and 102, the antennas 101 and 102 may form a current path. A magnetic field may be formed on the periphery of the antennas by the formed current path.

For example, when a current is supplied to the antennas 101 and 102, an electric signal at a specific frequency corresponding to the electric characteristics of the antenna may be selected, and the selected signal may be converted into a magnetic field signal through the antennas 101 and 102 and radiated outward.

For example, the antennas 101 and 102 may receive a magnetic field signal at a specific frequency (resonance frequency) according to the reciprocal principal that the antennas have, may convert the same into a current, and may transfer the same to a circuit electrically connected to the antennas 101 and 102.

The length (or the shape or the like) of the antennas 101 and 102 may be determined in view of the frequency band to be received. For example, a monopole antenna may utilize an image effect resulting from a ground portion of the antenna such that a specific frequency, which is configured such that the antenna length corresponding to ¼ wavelength, becomes the resonance frequency of the antenna, thereby transmitting/receiving the corresponding frequency band signal.

As illustrated in FIG. 1, the conventional antenna device 100 includes multiple antennas 101 and 102 having the same length L1 and selectively transmits/receives antenna signals with a good radiation efficiency.

Figure 2:
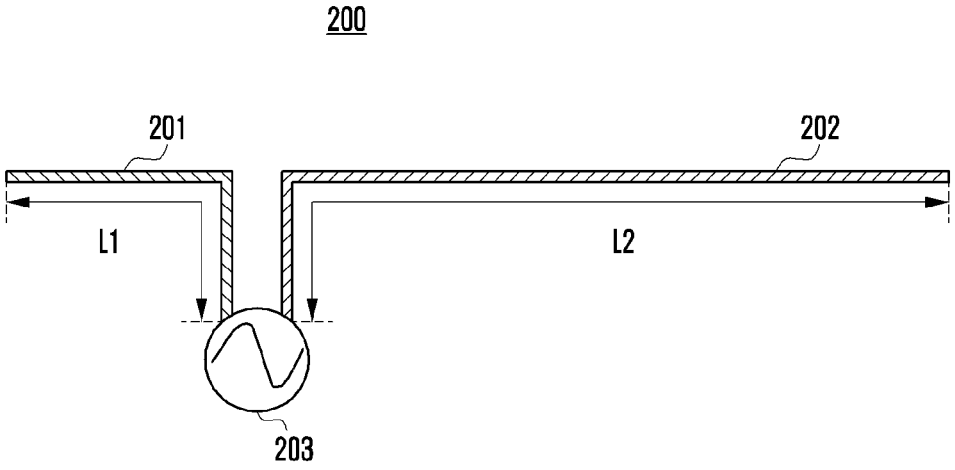
FIG. 2 is a diagram schematically illustrating an antenna device according to various embodiments of the disclosure.

FIG. 2 is a diagram schematically illustrating an antenna device 200 according to an embodiment of the disclosure.

The antenna device 200 according to various embodiments may include a first antenna 201 and a second antenna 202.

According to various embodiments, the first antenna 201 and the second antenna 202 may be physically arranged in different positions. For example, the first antenna 201 and the second antenna 202 may be arranged such that, in order to secure a directivity having a wider coverage, ends of respective antennas face in opposite directions.

The antenna device 200 according to various embodiments may include, in order to transmit/receive a specific frequency (first frequency) band signal, a first antenna 201, the resonance frequency of which is the first frequency, and a second antenna 202, the resonance frequency of which is a multiple of the first frequency.

For example, in order to have a specific frequency to be transmitted/received as the resonance frequency, the first antenna 201 may have a length corresponding to ¼ wavelength to 2 wavelengths of the specific frequency (first frequency).

According to various embodiments, the second antenna 202 may be configured to transmit/receive the same frequency band as the frequency (first frequency) band transmitted/received by the first antenna 201, and may have a length configured such that the resonance frequency of the second antenna 202 is a multiple of the first frequency.

For example, the length L2 of the second antenna 202 may be an integer multiple (the integer is equal to or larger than 2) of the length L1 of the first antenna 201 (L2=L1*n, n=2, 3, 4, . . . ).

According to various embodiments, each of the first antenna 201 and the second antenna 202 may resonate in a frequency band configured such that the length of each antenna corresponds to ¼ wavelength λ.

For example, when the length L2 of the second antenna 202 corresponds to two times the length L1 of the first antenna 201, the second antenna 202 may have a resonance frequency corresponding to twice the resonance frequency of the first antenna 201. In this case, the first antenna 201 and the second antenna 202 may both resonance in the resonance frequency band of the second antenna 202.

According to various embodiments, a specific frequency band (first frequency band) transmitted/received by the antenna device 200 may be a low-frequency band among frequency bands for IoT.

For example, the low-frequency band may correspond to to 600 MHz to 1 GHz, the mid-frequency band may correspond to 1.5 GHz to 2.2 GHz, and the high-frequency band may correspond to a frequency equal to or higher than 2.5 GHz. Frequency bands used for IoT services may be provided variously with regard to respective business providers or protocols. For example, in the case of a LoRa network or a Sigfox network, a band of 915 MHz to 922 MHz may be supported; and in the case of Cat-M1 or NB-IoT network, a band of 698 MMz to 960 Mhz may be supported.

According to various embodiments, signals in a first frequency band can be transmitted/received with a more improved radiation efficiency by using an antenna device 200 including a first antenna 201, the resonance frequency is a first frequency, and a second antenna 202, the resonance frequency of which is a multiple of the first frequency, compared with an antenna device including only the first antenna 201 or an antenna device including only the second antenna 202. For example, a radiation efficiency increase improved by an antenna device 200 including the first antenna 201 and the second antenna 202, compared with an antenna device including only the first antenna 201, is given in Table 1 below.

TABLE 1

| | | First device (first antenna) | | Second device (first antenna and second antenna) | |
|---|---|---|---|---|---|
| | | RSSI | PER | RSSI | PER |
| Condition 1 | 0° | −127~−130 | 0% | −123~−125 | 0% |
| | 90° | −127~−130 | 0% | −130~−135 | 0% |
| | 180° | −131~−144 | 13% | −130~−132 | 0% |
| | 270° | −124~−125 | 0% | −135~−138 | 0% |
| Condition 2 | 0° | −118~−124 | 0% | −118~−119 | 0% |
| | 90° | −118~−132 | 0% | −124~−125 | 0% |
| | 180° | −135~−143 | 15% | −124~−130 | 0% |
| | 270° | −118~−119 | 0% | −119~−124 | 0% |
| Condition 3 | 0° | −116 | 14% | −126 | 1% |
| | 90° | −130~−131 | 67% | −132~−unspecified | unspecified |
| | 180° | −132 | 50% | unspecified | 45% |
| | 270° | −127 | 38% | −126~−128 | 13% |

It can be confirmed from the results in Table 1 that, under multiple conditions, the antenna device 200 including the first antenna 201 and the second antenna 202 generally has higher RSSI values and low PER values than the antenna device including only the first antenna 201; and the radiation efficiency of the antenna device 200 is accordingly improved by including the second antenna 202, the resonance frequency of which is a multiple of the first frequency.

Reference sign 203 in FIG. 2 is for the purpose of schematically indicating that the first antenna 201 and the second antenna 202 are electrically connected in order to radiate the same frequency band signal.

According to various embodiments, each of the first antenna 201 and the second antenna 202 may include a feeding portion for receiving a supply of power and a ground portion used when electronic waves are transmitted/received. Each of the first antenna 201 and the second antenna 202 may operate separately.

Although not illustrated, the antenna device 200 according to various embodiments may further include a dielectric substance so as to electrically induce radiated electromagnetic waves such that the same can be radiated outward while having a uniform radiation pattern in all directions. For example, the dielectric substance may include various materials having a large permittivity, such as poly sterol, ferrite, and epoxy resin.

According to various embodiments, the space for distancing the first antenna 201 and the second antenna 202 from each other may be filled with a dielectric substance. The dielectric substance filling the space for distancing the first antenna and the second antenna from each other according to the disclosure may be air.

Figure 3A:
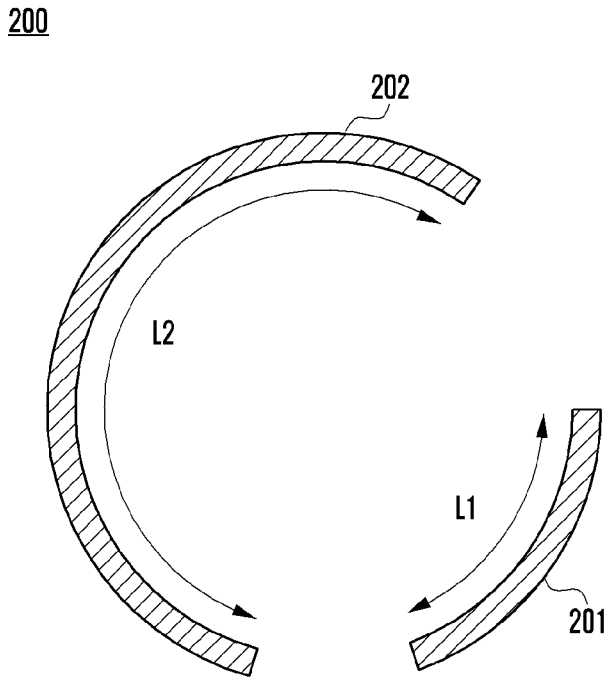
FIG. 3A to FIG. 3C are diagrams illustrating antenna arrangement schemes of antenna devices according to various embodiments of the disclosure.
Figure 3B:
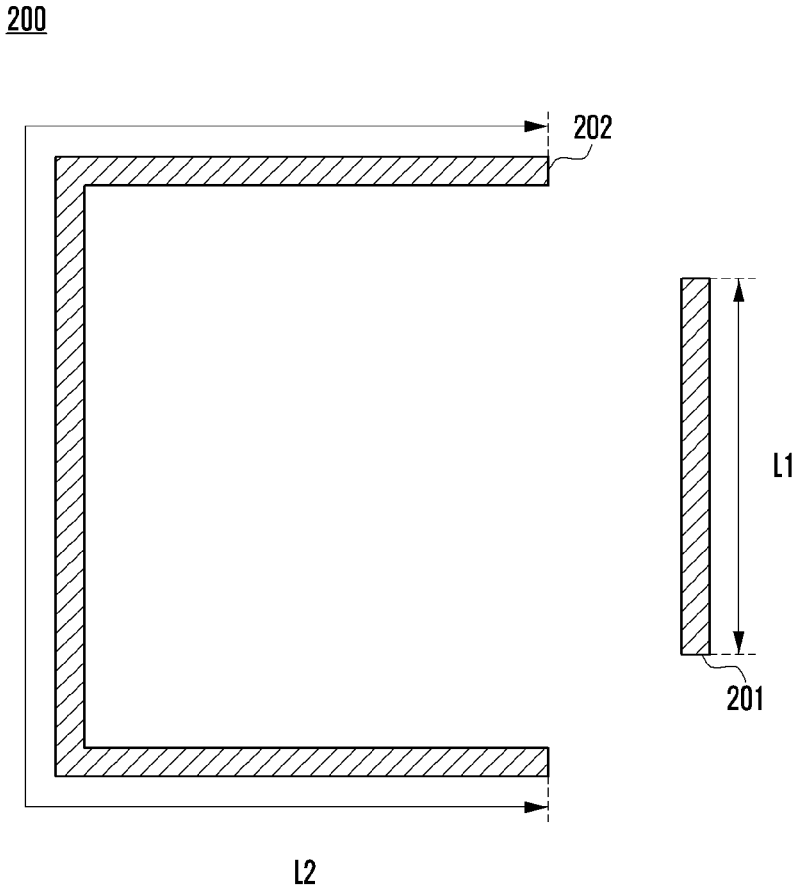
Figure 3C:
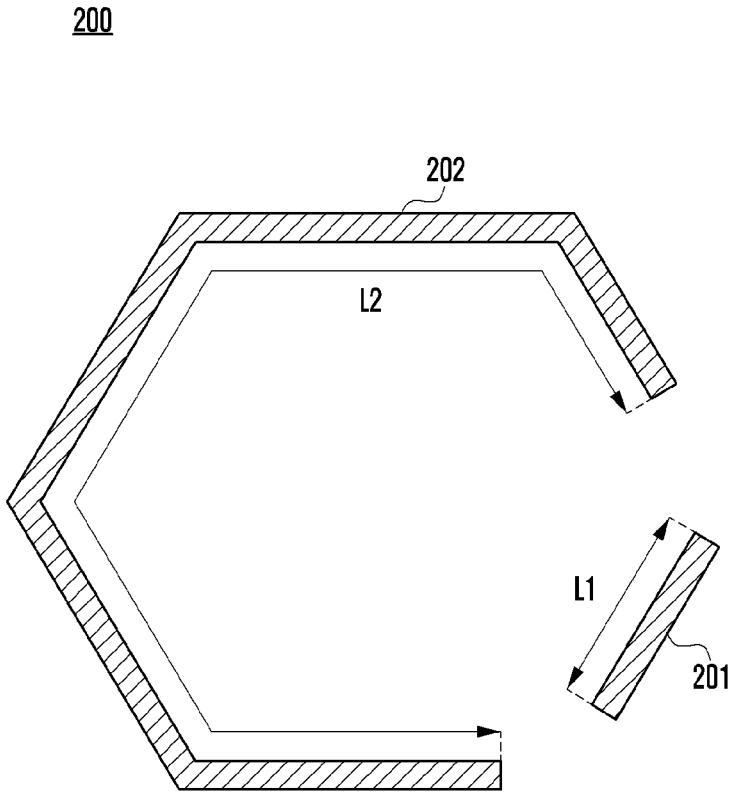

FIG. 3A to FIG. 3C are diagrams illustrating antenna arrangement schemes of antenna devices 200 according to various embodiments of the disclosure.

Although antenna devices including a first antenna 201 and a second antenna 202 are solely illustrated in FIG. 3A to FIG. 3C, an antenna device according to various embodiments of the disclosure may further include a third antenna (not illustrated) having the same length as the length of the first antenna 201 or the length of the second antenna 202.

Referring to FIG. 3A, the first antenna 201 and the second antenna 202 may be physically arranged in different positions. For example, the first antenna and the second antenna may be arranged in different positions on a substrate (for example, a printed circuit board (PCB) or a flexible printed circuit board (FPCB)) for providing respective antennas with electric signals.

In general, radio signals may undergo a loss due to an obstacle (for example, a building or a terrain) when transmitted/received by antenna devices. Therefore, antenna devices need to secure a directivity having a 360° coverage.

According to various embodiments, the first antenna 201 and the second antenna 202 may be arranged to be physically spaced from each other, in order to secure a directivity having a 360° coverage, such that, including the spacing intervals, the same form a substantially circumferential shape.

For example, the first antenna 201 and the second antenna 202 may form a curved shape having the same curvature. For example, one end of the first antenna 201 and one end of the second antenna 202 may be arranged to be spaced from each other by a first interval, and the other end of the second antenna 202 and the other end of the second antenna 202 may be arranged to be spaced from each other by a second interval.

For example, the first antenna 201 and the second antenna 202 may be arranged such that the first antenna 201, the first interval, the second antenna 202, and the second interval form, as a whole, a circumference on a single plane. In this regard, the length of the first antenna 201 may be L1, the length of the second antenna may be L2, and L2 may be an integer multiple (the integer is equal to or larger than 2) of the length L1 (L2=L1*n, n=2, 3, 4, . . . ).

The antenna device 200 according to various embodiments may further include a third antenna (not illustrated) having the same length as the length of the first antenna 201 or the length of the second antenna 202. For example, the first antenna 201, the second antenna 202, and the third antenna (not illustrated) may all be arranged in a curved shape having the same curvature such that the first antenna 201, the second antenna 202, and the third antenna (not illustrated), including intervals for spacing respective ends from each other, form a circumference on the same plane.

For example, the antenna device 200 according to various embodiments may further include a switch (not illustrated) capable of selectively supplying a current to the feeding portion of each antenna such that at least one of the first antenna 201, the second antenna 202, and the third antenna (not illustrated) is selectively controlled to operate.

According to another embodiment, as illustrated in FIG. 3B and FIG. 3C, the first antenna 201 and the second antenna 202 may be arranged to be physically spaced from each other such that, including intervals for spacing ends of respective antennas from each other, the same form a substantially regular polygonal shape on the same plane. In this regard, the length of the first antenna 201 may be L1, the length of the second antenna may be L2, and L2 may be an integer multiple (the integer is equal to or larger than 2) of the length L1 (L2=L1*n, n=2, 3, 4, . . . ).

The antenna device 200 according to various embodiments may further include a third antenna (not illustrated) having the same length as the length of the first antenna (201) or the length of the second antenna 202. For example, the first antenna 201 may have a length of L1, the second antenna 202 may have a length of L2, and the third antenna (not illustrated) may have a length of L1 or L2. The first antenna 201, the second antenna 202, and the third antenna (not illustrated) may be arranged to be spaced from each other such that, including intervals for spacing ends of respective antennas from each other, the same form a substantially regular polygonal shape on the same plane.

The antenna device 200 according to various embodiments may further include a switch (not illustrated) capable of selectively supplying a current to the feeding portion of each antenna such that at least one of the first antenna 201, the second antenna 202, and the third antenna (not illustrated) is selectively controlled to operate.

According to various embodiments, the space for distancing the first antenna 201 and the second antenna 202 from each other may be filled with a dielectric substance. The dielectric substance filling the space for distancing the first antenna 201 and the second antenna 202 from each other according to the disclosure may be air.

Antennas included in an antenna device 200 according to various embodiments may be arranged in various kinds of elliptical or polygonal shapes besides the shapes illustrated in FIG. 3A to FIG. 3C.

Reference sign 410 refers to a radiation pattern of an antenna device 200 having a first antenna 201 and a second antenna 202 arranged in a circumferential shape according to an embodiment of the disclosure, and reference sign 420 refers to a radiation pattern in a conventional single-antenna device. Each radiation pattern illustrates the orientation-specific field strength on a specific plane (for example, x-y plane) in order to compare the directivity when radio waves are transmitted/received by the antenna device.

Figure 4:
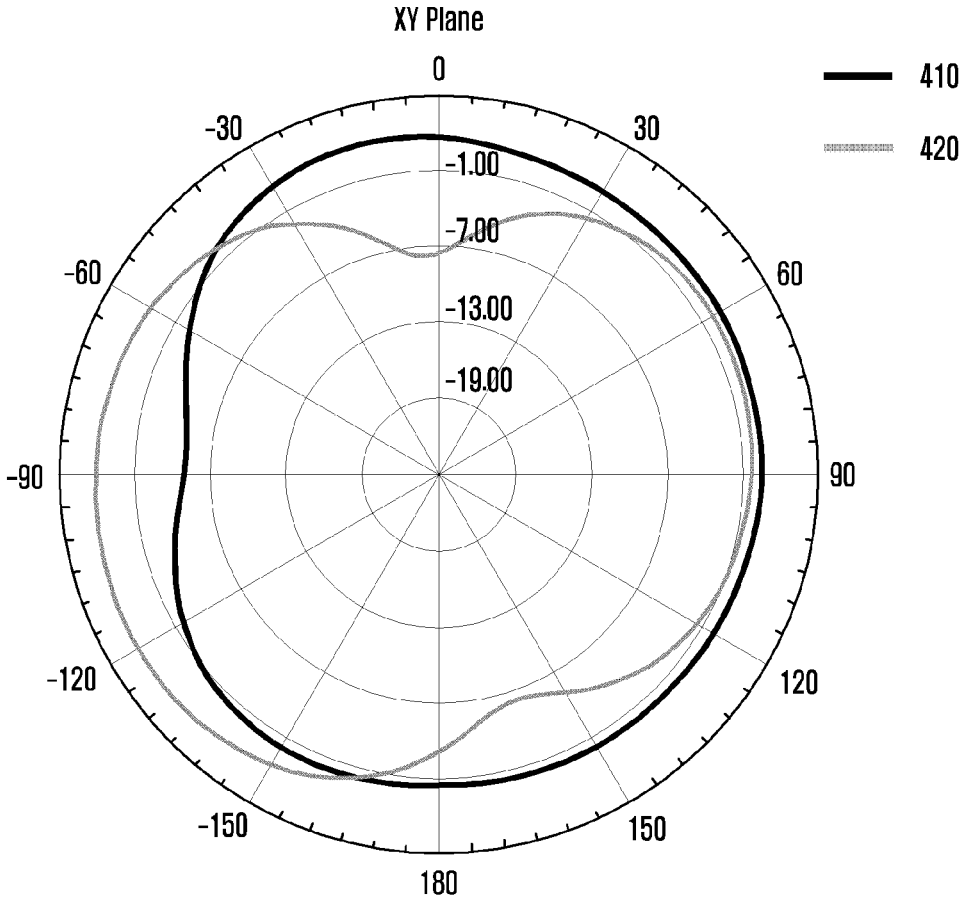
FIG. 4 is a diagram illustrating the directivity improvement effect when radio waves are transmitted/received by an antenna device according to an embodiment of the disclosure.

As illustrated in FIG. 4, the conventional single-antenna device has a low field strength in a specific orientation (for example, near 0° or 170°, and may fail to receive some signals transmitted in a specific direction. In the case of the antenna device 200 having a first antenna 201 and a second antenna 202 arranged in a circumferential shape, the radiation pattern is formed in a comparatively wide and even manner across the entire orientation, and thus is capable of securing a uniform antenna device performance regardless of the direction in which radio waves are transmitted/received.

It can be confirmed that, when the first antenna 201 and the second antenna 202 are arranged in a circumferential shape according to an embodiment of the disclosure, not only is the radiation efficiency improved compared with a structure in which a conventional single antenna is arranged linearly, but the radiation pattern is also formed in a wider and evener manner at a 360° coverage in terms of the directivity.

Figure 5:
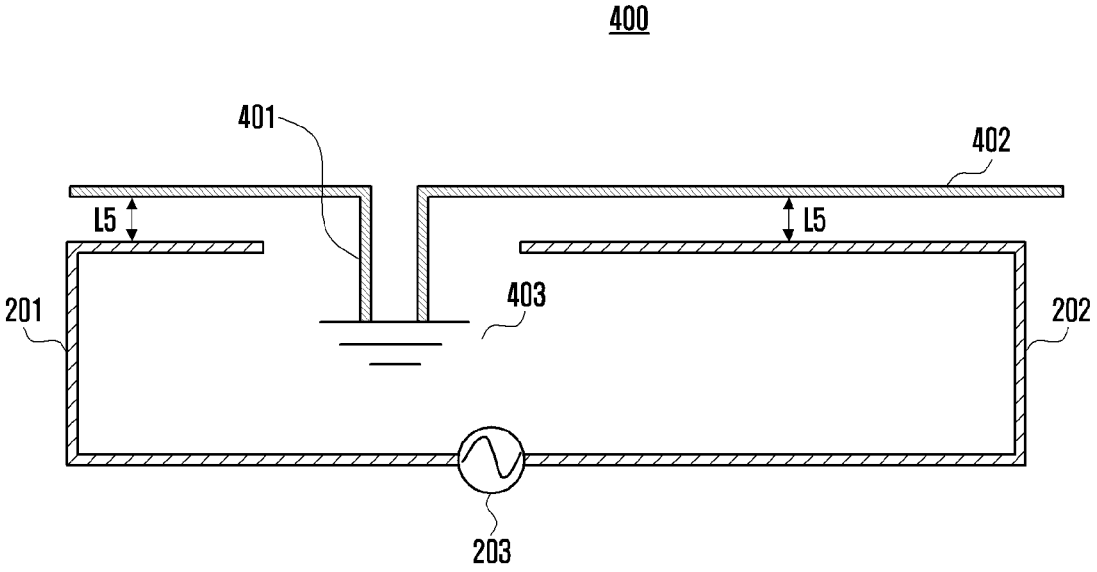
FIG. 5 is a diagram schematically illustrating the structure of an antenna device according to various embodiments of the disclosure.

FIG. 5 is a diagram schematically illustrating the structure of an antenna device according to various embodiments of the disclosure.

An antenna device including multiple antennas needs to have a distancing space between respective antennas, which is equal to or larger than 0.5 wavelength of the resonance frequency, in order to prevent performance degradation of each antenna. For example, unless the first antenna 201 and the second antenna 202 are arranged with a distancing space equal to or larger than 0.5 wavelength of the frequency band to be transmitted/received, mutual interference between the antennas may occur and degrade the isolation, thereby lowering the radiation efficiency of each antenna.

An antenna device 400 according to various embodiments of the disclosure may employ multiple metal patterns 401 and 402 that can be electromagnetically coupled with respective antennas such that, even if multiple antennas 201 and 202 are arranged adjacent to each other, performance degradation of each antenna can be prevented.

Referring to FIG. 5, the antenna device 400 according to various embodiments may include a first antenna 201, a second antenna 202, a first metal pattern 401, and a second metal pattern 402.

According to various embodiments, the first metal pattern 401 may be arranged to be spaced apart from the first antenna 201 by a predetermined distance L5, and one end thereof may be connected to a ground portion such that electromagnetic coupling with the first antenna 201 is formed.

According to various embodiments, the second metal pattern 402 may be arranged to be spaced apart from the second antenna 202 by a predetermined distance L5, and one end thereof may be connected to a ground portion such that electromagnetic coupling with the second antenna 202 is formed.

According to various embodiments, the length and width of the antennas 201 and 202 may be optimized according to the resonance frequency of each.

For example, the first antenna 201 may have a length configured such that the frequency to be transmitted/received by the antenna device 404 (first frequency) is the resonance frequency of the first antenna 201. For example, the length of the first antenna 201 may correspond to ¼ wavelength to 2 wavelengths of the first frequency band signal.

For example, the second antenna 202 may have a length configured such that a frequency corresponding to a multiple of the first frequency is the resonance frequency of the second antenna 202. For example, the second antenna 202 may have a length corresponding to ½ wavelength to 4 wavelengths of the first frequency band signal.

According to various embodiments, the length of the metal patterns 401 and 402 may be determined so as to correspond to the length of adjacent antennas 201 and 202. For example, the length of the first metal pattern 401 may be equal to the length of the first antenna 201 or smaller than the length of the first antenna 201. For example, the first metal pattern 401 may have a length corresponding to 0.95 times the length of the first antenna 201. For example, the length of the second metal pattern 402 may be equal to the length of the second antenna 202 or smaller than the length of the second antenna 202. For example, the second metal pattern 402 may have a length corresponding to 0.95 times the length of the second antenna 202.

According to various embodiments, the metal patterns 401 and 402 may be arranged to be spaced apart from the antennas by a predetermined distance. The spacing distance L5 may be defined as a distance at which an effect of electromagnetic coupling with the antennas can occur.

For example, the spacing distance L5 between the first metal pattern 401 and the first antenna 201 may corresponding to a length of 0.1 wavelength to 0.15 wavelength of the first frequency band signal. For example, the spacing distance L5 between the second metal pattern 402 and the second antenna 202 may corresponding to a length of 0.1 wavelength to 0.15 wavelength of the first frequency band signal.

Figure 6A:
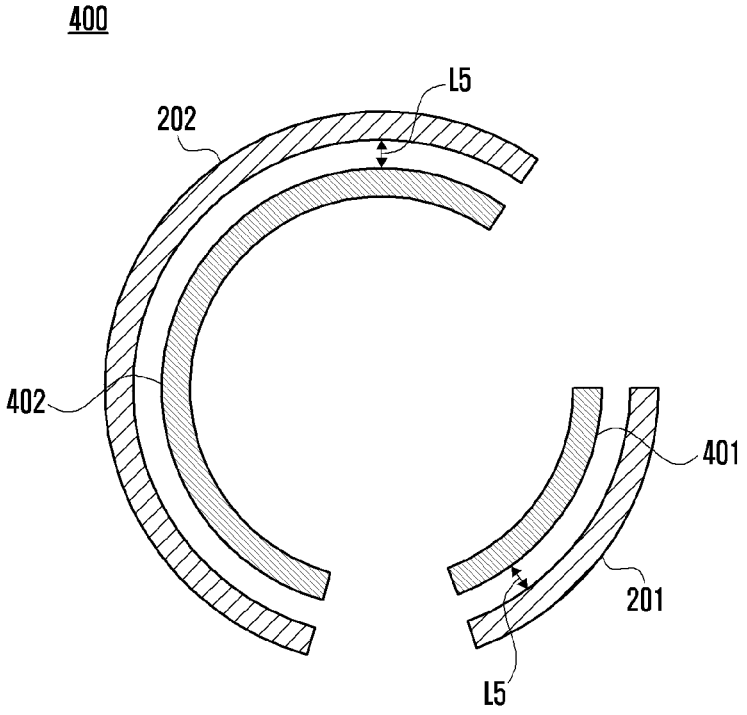
FIG. 6A to FIG. 6C are diagrams illustrating arrangement structures of antennas and metal patterns in connection with antenna devices according to various embodiments of the disclosure.
Figure 6B:
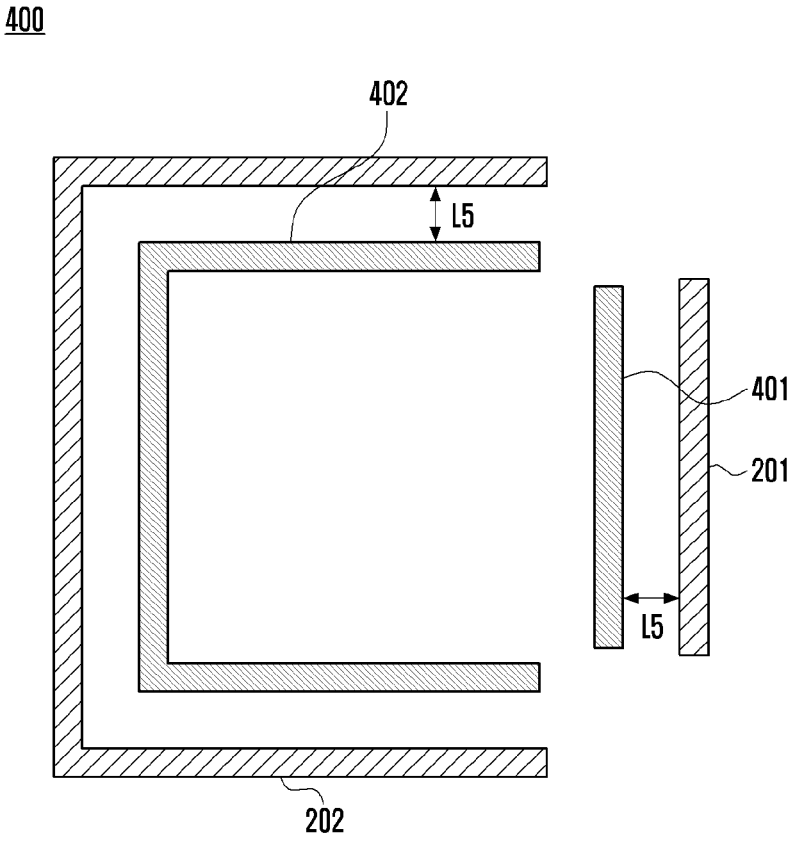
Figure 6C:
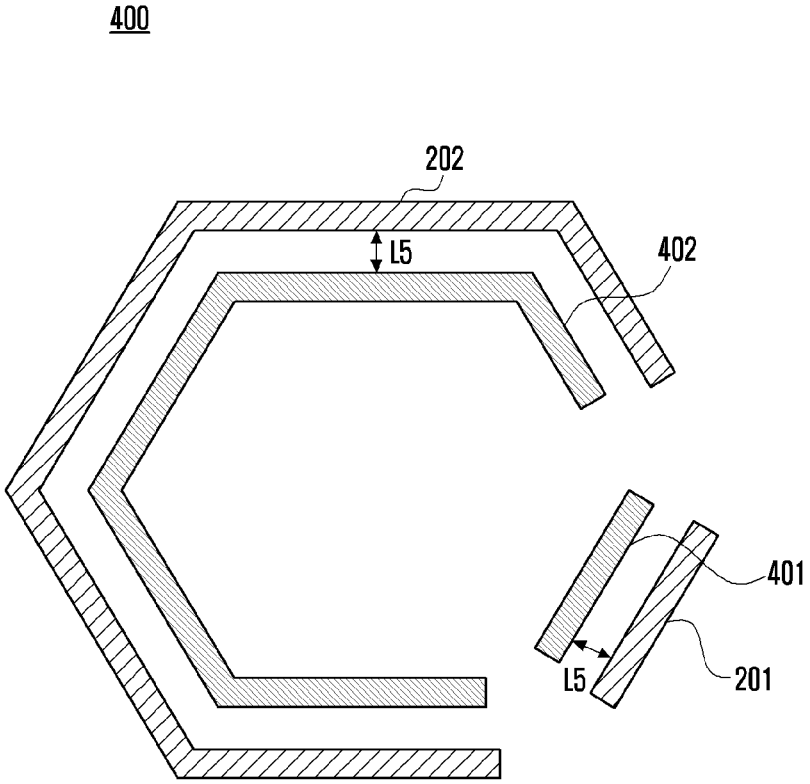

FIG. 6A to FIG. 6C are diagrams illustrating arrangement structures of antennas 201 and 202 and metal patterns 401 and 402 in connection with antenna devices 400 according to various embodiments of the disclosure.

According to various embodiments, the first antenna 201 and the second antenna 202 may be arranged to be physically spaced from each other on the same plane such that, including the spacing intervals, the same form a substantially circumferential shape.

According to various embodiments, the metal patterns 401 and 402 may be arranged to be spaced apart from the antennas 201 and 202 by a predetermined distance along the inner peripheral surface or outer peripheral surface of such a circumferential shape. For example, the first metal pattern 401 may be arranged to be spaced apart from the first antenna 201 by a distance of L5, and the second metal pattern 402 may be arranged to be spaced apart from the second antenna 202 by a distance of L5.

For example, the interval L5 of spacing between the metal patterns 401 and 402 and respective antennas 201 and 202 may be set to be a length corresponding to 0.1 wavelength to 0.15 wavelength of the first frequency, which is the frequency band to be transmitted/received by the antennas 201 and 202, in order to generate an electromagnetic coupling effect with respective adjacent antennas 201 and 202.

For example, the length of the metal patterns 401 and 402 may be determined so as to correspond to the length of adjacent antennas 201 and 202. For example, the length of the first metal pattern 401 may be equal to or smaller than the length of the first antenna 201. For example, the length of the first metal pattern 401 may correspond to 0.95 times the length of the first antenna 201. For example, the length of the second metal pattern 402 may be equal to or smaller than the length of the second antenna 202. For example, the length of the second metal pattern 402 may correspond to 0.95 times the length of the second antenna 202.

According to various embodiments, the first antenna 201 and the second antenna 202 may be arranged to be physically spaced from each other on the same plane such that, including the spacing intervals, the same form a substantially regular polygonal shape.

According to various embodiments, the metal patterns 401 and 402 may be arranged adjacent to antennas having such a regular polygonal shape to be spaced apart from the antennas by a predetermined distance.

For example, the first metal pattern 401 may be arranged to be spaced apart from the first antenna 201 by a distance of L5, and the second metal pattern 402 may be arranged to be spaced apart from the second antenna 202 by a distance of L5 such that the first metal pattern 401 and the second metal pattern 402 are arranged in a regular polygonal shape. For example, the spacing distance L5 between the first metal pattern 401 and the first antenna 201 and the spacing distance L5 between the second metal pattern 402 and the second antenna 202 may correspond to the length of 0.1 wavelength to 0.15 wavelength of the first frequency band signal.

Figure 7:
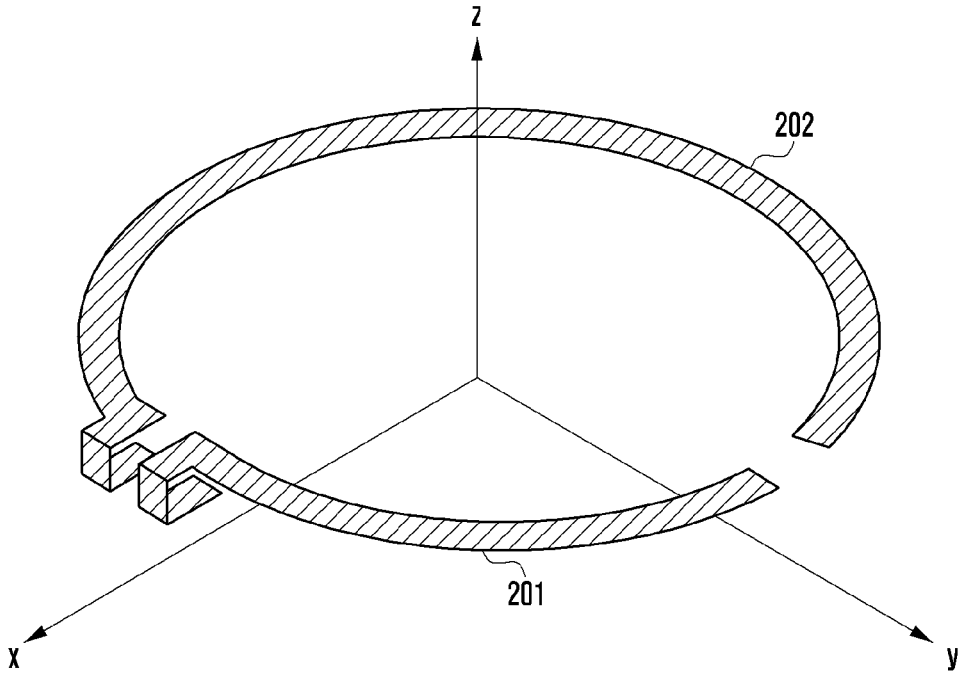
FIG. 7 is a diagram illustrating the perspective view of an antenna device according to an embodiment of the disclosure.

FIG. 7 is a diagram illustrating the perspective view of an antenna device 400 according to an embodiment of the disclosure.

The antenna device 400 according to an embodiment may include a first antenna 201 and a second antenna 202.

For example, in order to transmit/receive a first frequency band signal, the first antenna 201 of the antenna device 400 may have a length L1 configured such that the resonance frequency thereof is the first frequency, the second antenna 202 may have a length L2 configured such that the resonance frequency thereof is a multiple of the first frequency, and the first antenna 201 and the second antenna 202 may be arranged to be physically spaced from each other such that, including the spacing intervals, the same form a substantially circumferential shape on a single plane (for example, x-y plane).

For example, the length L2 of the second antenna 202 may be larger than the length L1 of the first antenna 201, and may correspond to an integer (which is equal to or larger than 2) multiple of the length L1 of the first antenna 201.

According to an embodiment, the first antenna 201 and the second antenna 202 may be arranged such that, if necessary, ends thereof extend along the −z axis, in order to adjust the length such that a required frequency band signal can be transmitted/received. Ends of the first antenna 201 and the second antenna 202 may be connected to a feeding portion such that each of the first antenna 201 and the second antenna 202 can be supplied with power.

According to another embodiment, the antenna device 400 may include a switch (not illustrated) such that at least one of the first antenna 201 and the second antenna 202 can be supplied with power. For example, the switch may supply power to both the first antenna 201 and the second antenna 202 such that first frequency band signal can be received from the first antenna 201 and the second antenna 202. For example, the switch may selectively provide power to the first antenna 201 or the second antenna 202 so as to select an antenna 201 or 202 by which signals will be transmitted/received.

Figure 8:
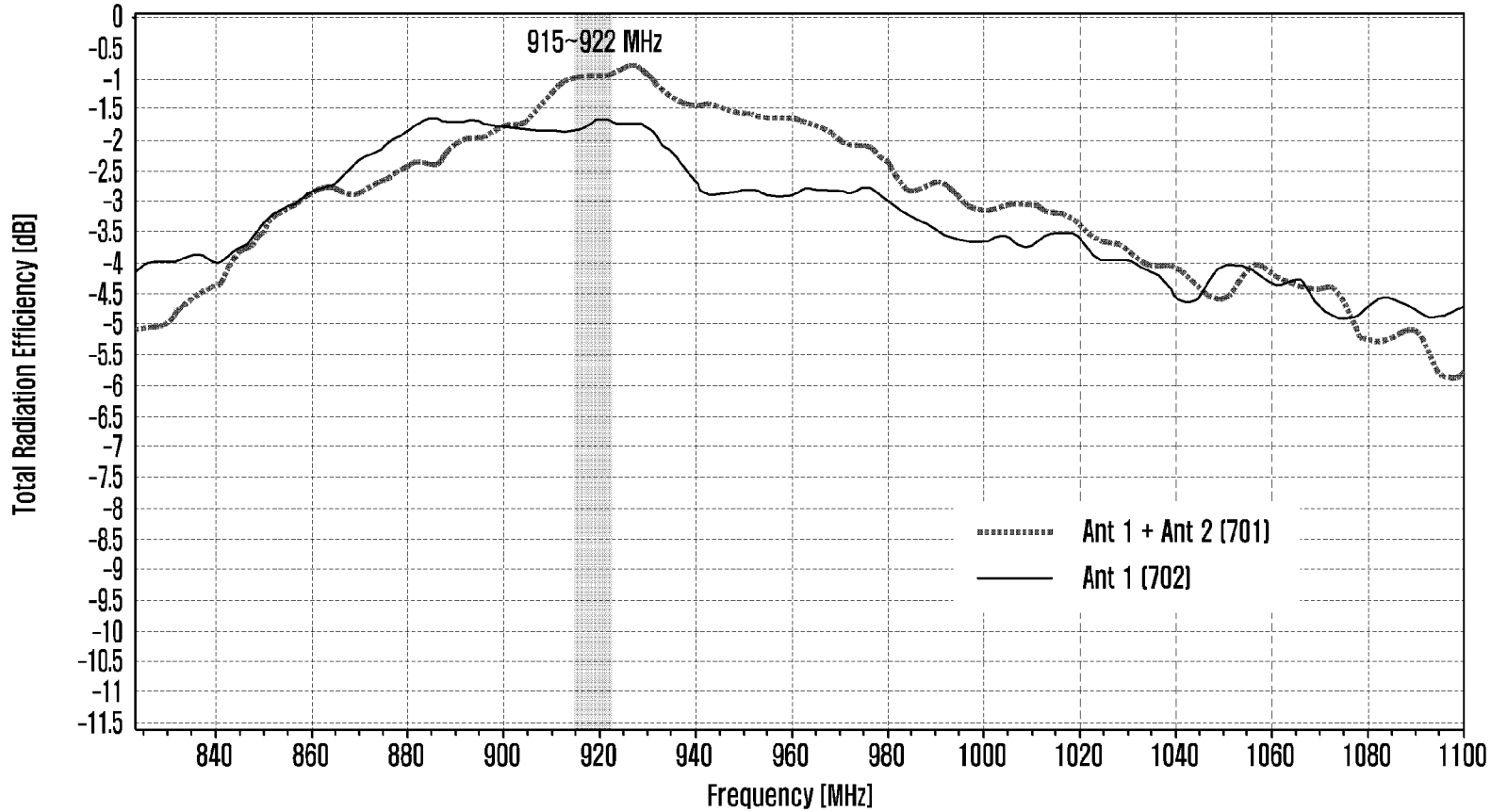
FIG. 8 is a graph illustrating radiation efficiency characteristics of an antenna device according to an embodiment of the disclosure.

FIG. 8 is a graph illustrating radiation efficiency characteristics of an antenna device 400 according to an embodiment of the disclosure.

As illustrated in FIG. 8, the horizontal axis of the graph indicates the frequency [MHz], and the vertical axis indicates the total radiation efficiency [dB] acquired from the antenna. The solid line 702 denotes frequency-specific radiation efficiency of an antenna device including only a first antenna 201, and the broken line 701 denotes frequency-specific radiation efficiency of an antenna device 400 including both the first antenna 201 and the second antenna 202 illustrated in FIG. 7.

For example, the first frequency band to be transmitted/received by the antenna device 400 may be 915-922 MHz.

Referring to FIG. 8, in the first frequency band (for example, low-frequency band of frequency bands for IoT), the peak gain of an antenna device including only a first antenna 201, the resonance frequency of which is the first frequency, is about −1.7 dBi, and the peak gain of an antenna device 400 further including a second antenna 202, the resonance frequency of which is a multiple of the first frequency (for example, three times the first frequency) is about −0.8 dBi. That is, it can be confirmed that, when the antenna device 400 according to an embodiment of the disclosure is used, the radiation efficiency is improved compared with the antenna device including only the first antenna 201.

Figure 9:
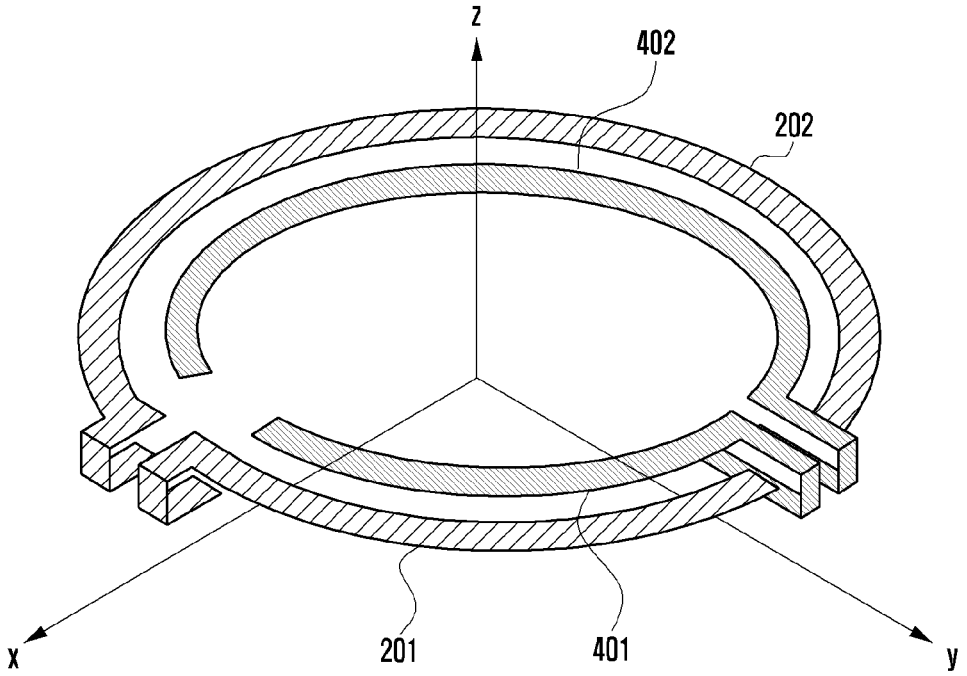
FIG. 9 is a diagram illustrating the perspective view of an antenna device according to an embodiment of the disclosure.

FIG. 9 is a diagram illustrating the perspective view of an antenna device 400 according to an embodiment of the disclosure.

The antenna device 400 according to an embodiment may include a first antenna 201, a second antenna 202, a first metal pattern 401, and a second metal pattern 402.

For example, in order to transmit/receive a first frequency band signal, the first antenna 201 of the antenna device may have a length L1 configured such that the resonance frequency thereof is the first frequency, and the second antenna 202 may have a length L2 configured such that the resonance frequency thereof is a multiple of the first frequency. For example, the first antenna 201 and the second antenna 202 may be arranged to be physically distanced from each other such that, including the spacing intervals, the same form a substantially single circumferential shape on the same plane.

For example, the length of the first metal pattern 401 may be equal to or smaller than the length of the first antenna 201. The length of the second metal pattern 402 may be equal to or smaller than the length of the second antenna 202. For example, the first metal pattern 401 may have a length corresponding to 0.95 times the length of the first antenna 201 (0.95*L1), and the second metal pattern 402 may have a length corresponding to 0.95 times the length of the second antenna 202 (0.95*L2). For example, the first metal pattern 401 and the second metal pattern 402 may be arranged to be spaced apart from the antennas 201 and 202, respectively, by a predetermined distance L5 along the circumferential inner peripheral surface or outer peripheral surface of the antennas 201 and 202. For example, the interval L5 of spacing between the metal patterns 401 and 402 and the antennas 201 and 202 may be set to be a length corresponding to 0.1 wavelength to 0.15 wavelength of the first frequency such that the adjacent antennas 201 and 202 and the metal patterns 401 and 402 have an electromagnetic coupling effect.

According to an embodiment, the first metal pattern 401 and the second metal pattern 402 may be arranged such that, if necessary, ends thereof extend along the −z axis. One end of each of the first metal pattern 401 and the second metal pattern 402 may be connected to a ground portion.

Figure 10:
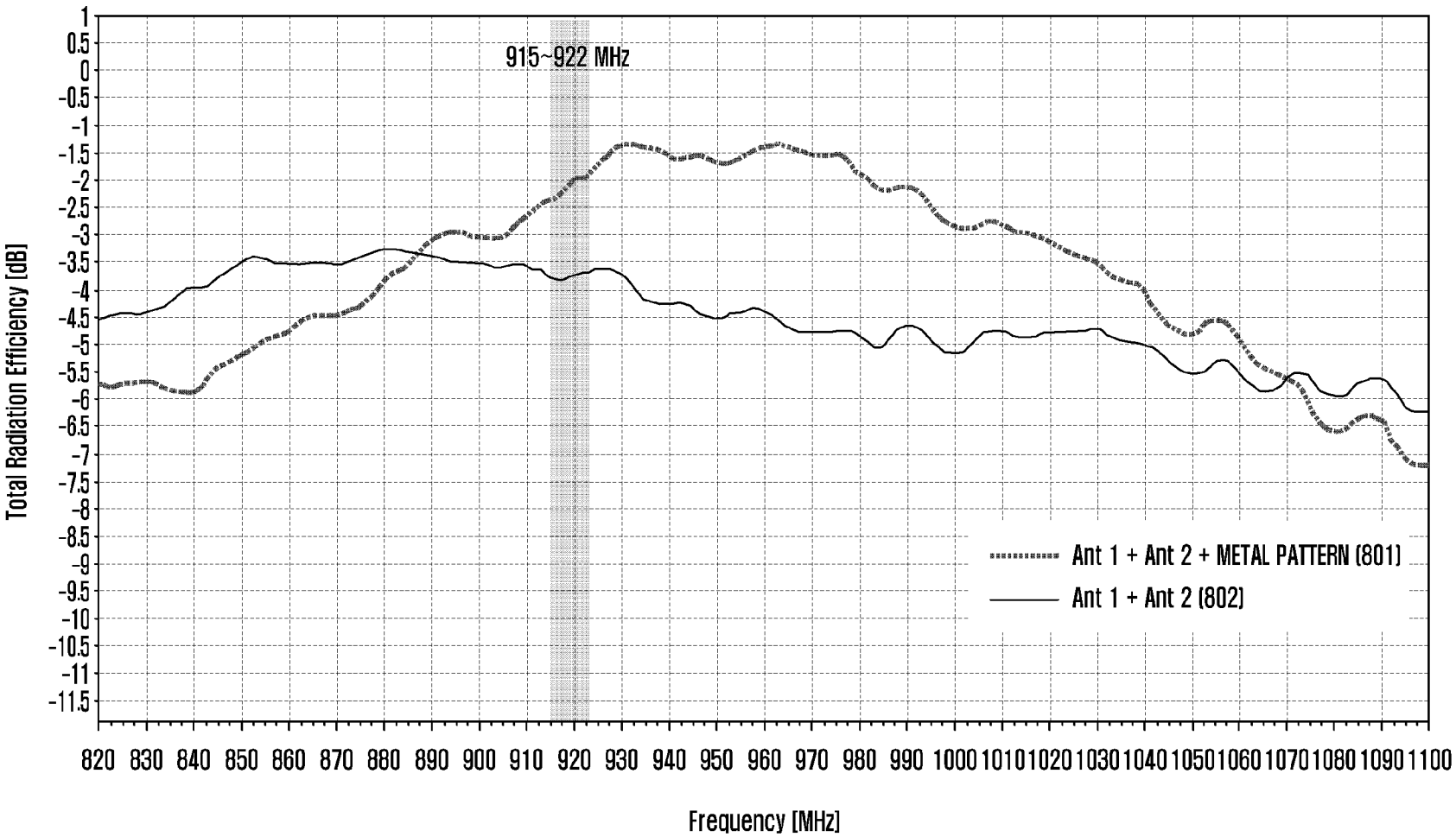
FIG. 10 is a graph illustrating radiation efficiency characteristics of an antenna device including a metal pattern according to various embodiments of the disclosure.

FIG. 10 is a graph illustrating radiation efficiency characteristics of an antenna device including metal patterns 401 and 402 according to various embodiments of the disclosure.

As illustrated in FIG. 10, the horizontal axis of the graph indicates the frequency [MHz], and the vertical axis indicates the total radiation efficiency [dB] acquired from the antenna. The solid line 802 denotes frequency-specific radiation efficiency of the antenna device illustrated in FIG. 7, and the broken line 802 denotes frequency-specific antenna efficiency of the antenna device including metal patterns 401 and 402 illustrated in FIG. 9.

For example, the first frequency band to be transmitted/received by the antenna device 400 may be a low-frequency band among frequency bands for IoT.

In the first frequency band (for example, 915-922 MHz), the peak gain of the antenna device including no metal patterns 401 and 402 is about −3.8 dBi, and the peak gain of the antenna device including metal patterns 401 and 402 is about −2.0 dBi. That is, it can be confirmed that, when the antenna device including metal patterns 401 and 402 according to an embodiment of the disclosure is used, the radiation efficiency is improved compared with the antenna device including no metal patterns 401 and 402.

The term "module" as used herein may, for example, mean a unit including one of hardware, software, and firmware or a combination of two or more of them. The "module" may be interchangeably used with, for example, the term "unit", "logic", "logical block", "component", or "circuit". The "module" may be a minimum unit of an integrated component element or a part thereof. The "module" may be a minimum unit for performing one or more functions or a part thereof. The "module" may be mechanically or electronically implemented. For example, the "module" according to the disclosure may include at least one of an Application-Specific Integrated Circuit (ASIC) chip, a Field-Programmable Gate Arrays (FPGA), and a programmable-logic device for performing operations which has been known or are to be developed hereinafter.

Embodiments of the disclosure disclosed in the specification and the drawings are only particular examples to easily describe the technical matters of the disclosure and assist in the understanding of the disclosure, and do not limit the scope of the disclosure. It is apparent to those skilled in the art that other modified examples based on the technical idea of the disclosure can be implemented as well as the embodiments disclosed herein.

The invention claimed is:

1. An antenna device comprising:

a first antenna having a first frequency as a resonance frequency thereof, the first antenna being configured to transmit/receive a first frequency band signal; and a second antenna having a multiple of the first frequency as a resonance frequency thereof, the second antenna being arranged adjacent to the first antenna so as to transmit/receive the first frequency band signal, wherein: one end of the first antenna and one end of the second antenna, and the other end of the first antenna and the other end of the second antenna are arranged to be spaced apart by a predetermined distance, respectively; and the first antenna and the second antenna are arranged such that the first antenna, the second antenna, and spacing intervals as a whole form a substantially circumferential shape.

2. The antenna device as claimed in claim 1, wherein a length of the first antenna is ¼ wavelength to 2 wavelengths of the first frequency band signal.

3. The antenna device as claimed in claim 1, wherein a length of the second antenna is ½ wavelength to 4 wavelengths of the first frequency band signal.

4. The antenna device as claimed in claim 1, wherein the antenna device further comprises:

a first metal pattern arranged to be spaced apart from the first antenna by a predetermined distance and configured to form electromagnetic coupling with the first antenna; and a second metal pattern arranged to be spaced apart from the second antenna by a predetermined distance and configured to form electromagnetic coupling with the second antenna, and one end of the first metal pattern and one end of the second metal pattern are connected to a ground portion, respectively.

5. The antenna device as claimed in claim 4, wherein the first antenna and the first metal pattern, and the second antenna and the second metal pattern are arranged to be spaced apart by a length larger than 1/10 wavelength of the first frequency band signal and smaller than 3/20 wavelength thereof, respectively.

6. The antenna device as claimed in claim 4, wherein a length of the first antenna is ¼ wavelength to 2 wavelengths of the first frequency band signal, and a length of the first metal pattern is equal to or smaller than a length of the first antenna.

7. The antenna device as claimed in claim 1, wherein a band of the first frequency is a low-frequency band among frequency bands for IoT.

8. An antenna device comprising:

a first antenna having a first frequency as a resonance frequency thereof, the first antenna being configured to transmit/receive a first frequency band signal; and a second antenna having a multiple of the first frequency as a resonance frequency thereof, the second antenna being arranged adjacent to the first antenna so as to transmit/receive the first frequency band signal, wherein one end of the first antenna and one end of the second antenna, and the other end of the first antenna and the other end of the second antenna are arranged to be spaced apart by a predetermined distance, respectively; and the first antenna and the second antenna are arranged such that the first antenna, the second antenna, and spacing intervals as a whole form a substantially regular polygonal shape.

9. The antenna device as claimed in claim 8, wherein the antenna device further comprises:

a first metal pattern arranged to be spaced apart from the first antenna by a predetermined distance and configured to form electromagnetic coupling with the first antenna; and a second metal pattern arranged to be spaced apart from the second antenna by a predetermined distance and configured to form electromagnetic coupling with the second antenna, and one end of the first metal pattern and one end of the second metal pattern are connected to a ground portion, respectively.

* * * * *